US009983524B2

(12) United States Patent
Namisaki et al.

(10) Patent No.: US 9,983,524 B2
(45) Date of Patent: May 29, 2018

(54) FIXING DEVICE AND IMAGE FORMING APPARATUS

(71) Applicant: Sharp Kabushiki Kaisha, Osaka (JP)

(72) Inventors: Kousuke Namisaki, Osaka (JP); Masayuki Nakanishi, Osaka (JP); Masatsugu Ohishi, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days. days.

(21) Appl. No.: 15/375,429

(22) Filed: Dec. 12, 2016

(65) Prior Publication Data

US 2017/0168438 A1 Jun. 15, 2017

(30) Foreign Application Priority Data

Dec. 15, 2015 (JP) ..... 2015-243886
Oct. 7, 2016 (JP) ..... 2016-198720

(51) Int. Cl.
*G03G 15/20* (2006.01)

(52) U.S. Cl.
CPC ..... *G03G 15/2053* (2013.01); *G03G 15/2042* (2013.01); *G03G 15/2082* (2013.01); *G03G 2215/2029* (2013.01)

(58) Field of Classification Search
CPC ..... G03G 15/2039–15/205; G03G 15/2078; G03G 15/2082; G03G 2215/2029; G03G 15/2053
See application file for complete search history.

(56) References Cited

U.S. PATENT DOCUMENTS

2012/0201579 A1* 8/2012 Kunii ..... G03G 15/6585 399/328
2013/0189004 A1* 7/2013 Clark ..... G03G 15/2028 399/323
2013/0272756 A1* 10/2013 Nagata ..... G03G 15/2085 399/323

FOREIGN PATENT DOCUMENTS

JP 2008-275873 A 11/2008

* cited by examiner

*Primary Examiner* — Carla Therrien
(74) *Attorney, Agent, or Firm* — ScienBiziP, P.C.

(57) ABSTRACT

A fixing portion is provided with a fixing roller, a heating roller having a heat source, a fixing belt stretched between the fixing roller and the heating roller, and a pressurizing roller that is brought into pressure contact with the fixing roller across the fixing belt and forms a nip portion into which a sheet of paper is conveyed between the fixing belt and the pressurizing roller. The fixing portion is further provided with a pad that has a contact surface portion in contact with the inner peripheral surface of the fixing belt, and a biasing member that biases the pad in a direction in which the contact surface portion is brought into pressure contact with the inner peripheral surface of the fixing belt. The pad is configured so as to pivot about the rotating shaft of the heating roller.

8 Claims, 8 Drawing Sheets

FIXING DEVICE AND IMAGE FORMING APPARATUS

CROSS REFERENCE

This Nonprovisional application claims priority under 35 U.S.C. § 119(a) on Patent Application No. 2015-243886 filed in Japan on Dec. 15, 2015, and Patent Application No. 2016-198720 filed in Japan on Oct. 7, 2016, the entire contents of which are hereby incorporated by reference.

BACKGROUND OF THE INVENTION

The present invention relates to a fixing device provided with a heating roller, a fixing roller, and an endless belt stretched between the heating roller and the fixing roller and configured to transfer heat generated from the heating roller to the fixing roller through the endless belt and also relates to an image forming apparatus provided with such a fixing device.

An electrophotographic image forming apparatus is provided with a fixing device that fixes a toner image to a sheet of paper by heating and pressurizing the sheet bearing the toner image on the sheet of paper. Some fixing devices are provided with a heating roller, a fixing roller, and an endless belt stretched between the heating roller and the fixing roller and configured to heat the fixing roller by transferring heat generated from the heating roller to the fixing roller through the endless belt.

In such a fixing device, in order to adjust the tension of the endless belt, for example, the heating roller is biased by a plurality of biasing members in a direction in which the tension of the endless belt increases. In the fixing device, however, since the contact area between the heating roller and the endless belt is large, the meandering in which the endless belt deviates toward one side or deviates toward the other side in the width direction of the endless belt has been liable to occur due to the variation of the biasing force of the biasing member in the axial direction of the heating roller or the fixing roller, in other words, in the width direction of the endless belt.

Thus, instead of biasing the heating roller, a fixing device that is further provided with a tension roller that is brought into pressure contact with the inner peripheral surface of an endless belt has been proposed. In the fixing device, since the tension roller is brought into pressure contact with the endless belt between the heating roller and the fixing roller in a flatter state as compared with the endless belt in contact with the peripheral surface of the heating roller, the contact area between the tension roller and the endless belt becomes comparatively small and the meandering of the endless belt becomes comparatively small.

Incidentally, in recent years, in the fixing device, in order to shorten the warm-up time of the fixing device, the various rollers and the endless belt have become thinner, and the decrease in thermal capacity has progressed. Therefore, in the width direction of the endless belt, temperature unevenness is liable to occur in the endless belt. When the temperature unevenness occurs in the endless belt, unevenness occurs in the degree of fixing a toner image onto a sheet of paper, which may cause the image quality to be deteriorated.

In view of the foregoing, a proposal has been made of a fixing device including a roller that is movable toward and away with respect to the inner peripheral surface of an endless belt and being configured so that, when a temperature in a non-sheet passing area of the endless belt becomes equal to or higher than a predetermined temperature, the roller is brought into contact with the inner peripheral surface of the endless belt so as to release the heat of the endless belt to the roller, and then an excessive temperature rise of the non-sheet passing area of the endless belt is significantly reduced or prevented and reduction in temperature unevenness in the width direction of the endless belt is attained (see Japanese Patent Laid-Open publication No. 2008-275873, for example).

In the fixing device disclosed in Japanese Patent Laid-Open publication No. 2008-275873, since a member in contact with the inner peripheral surface of the endless belt is a roller, the contact area between the roller and the endless belt is small and the heat transfer efficiency is low. Therefore, the reduction effect of the temperature unevenness in the width direction of the endless belt is small. On the other hand, in a case in which the contact area between the member in contact with the inner peripheral surface of the endless belt and the endless belt is made large, although the heat transfer efficiency becomes high and thus the reduction effect of the temperature unevenness becomes high, the meandering of the endless belt may become large since the stabilization of the conveying performance of the endless belt has not been considered in the configuration of conventional fixing devices. In addition, when the endless belt flaps, the contact area between the heating roller and the endless belt changes, the amount of heat that the endless belt receives from the heating roller varies, and thus the temperature of the endless belt may not be stabilized.

SUMMARY OF THE INVENTION

Preferred embodiments of the present invention provide a fixing device capable of reducing temperature unevenness in the width direction of an endless belt and significantly reducing or preventing the meandering of the endless belt and also provide an image forming apparatus provided with such a fixing device.

A fixing device according to a preferred embodiment of the present invention is provided with a fixing roller, a heating roller, an endless belt, a pad, and a biasing member. The heating roller has a heat source. The endless belt is stretched between the fixing roller and the heating roller. A nip portion into which a sheet of paper is conveyed is formed between the fixing roller and a body such as a pressurized body is brought into pressure contact with the fixing roller across the endless belt. The pad has a contact surface in contact with the inner peripheral surface of the endless belt. The biasing member biases the pad in a direction in which the contact surface is brought into pressure contact with the inner peripheral surface of the endless belt. The pad is configured so as to pivot about the rotating shaft of the heating roller in response to a biasing force.

In the configuration, the pad is brought into pressure contact with the inner peripheral surface of the endless belt and thus the tension of the endless belt is adjusted. Since the pad is brought into pressure contact with the inner peripheral surface of the endless belt, it is possible to make the contact area between the pad and the endless belt larger while reducing the volume of the pad as compared with a case in which the roller is brought into pressure contact with the endless belt. A large contact area between the pad and the endless belt increases the heat transfer efficiency and reduces the temperature unevenness in the width direction of the endless belt.

In addition, since the pad pivots about the rotating shaft of the heating roller, the contact surface of the pad is oriented so that one end portion of the contact area between the heating roller and the endless belt is always positioned on the extension of the contact surface of the pad. Therefore, a distance between the contact area between the pad and the endless belt and the contact area between the heating roller and the endless belt becomes constant regardless of pivoting of the pad. Accordingly, the distance between the contact area between the pad and the endless belt and the contact area between the heating roller and the endless belt is configured to be as small as possible, which makes it possible to prevent the distance from becoming larger even if the pad pivots. Therefore, the flap of the endless belt is able to be significantly reduced or prevented.

Since the flap of the endless belt is significantly reduced or prevented, the change in the contact area between the heating roller and the endless belt is significantly reduced or prevented, the amount of heat that the endless belt receives from the heating roller is stabilized, and thus the temperature of the endless belt is also stabilized.

According to the present invention, the temperature unevenness in the width direction of the endless belt is able to be reduced.

The foregoing and other features and attendant advantages of the present invention will become more apparent from the reading of the following detailed description of the preferred embodiments with reference to the attached drawings.

DETAILED DESCRIPTION OF THE EMBODIMENTS

First Preferred Embodiment

Figure 1:
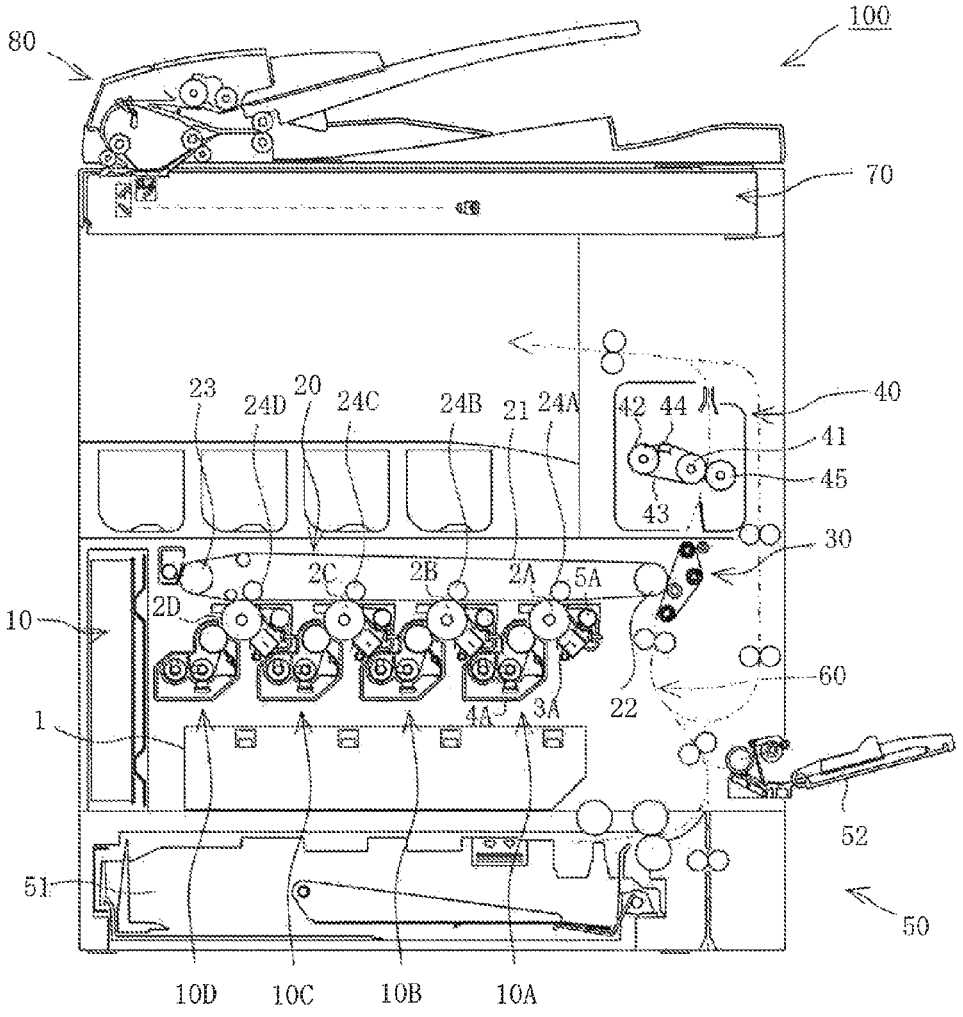
FIG. 1 is a side view illustrating a schematic configuration of an image forming apparatus.

As illustrated in FIG. 1, an image forming apparatus 100 is provided with an image forming portion 10, an intermediate transfer portion 20, a secondary transfer portion 30, a fixing portion 40, a sheet feed portion 50, a sheet conveying path 60, and a reading portion 70, and also includes an automatic document feeder 80 mounted at an upper portion of an apparatus body. The image forming apparatus 100 prints, in color or in monochrome on a sheet of paper, color or monochrome image data read through the reading portion 70 or color or monochrome image data that has been input from a non-illustrated external device.

The image forming portion 10 is provided with a light beam scanning unit 1 and image forming portions 10A, 10B, 10C, and 10D each of which corresponds to a single color and has a similar structure. The light beam scanning unit 1 is provided with a semiconductor laser, converts the image data of each of R, G, and B color pixels corresponding to a color document read through the reading portion 70 to concentration data of colors: black (K), cyan (C), magenta (M), and yellow (Y), exposes and scans the surfaces of photoreceptor drums 2A, 2B, 2C, and 2D of the image forming portions 10A to 10D in an axial direction (a primary scanning direction) with laser light modulated using a duty ratio corresponding to converted concentration data of each of the colors, and then forms an electrostatic latent image of each color. The image forming portion 10A to be described as a representative example is provided with the photoreceptor drum 2A as an image bearing member and is also provided with a charging device 3A, a developing device 4A, and a cleaning portion 5A around the photoreceptor drum 2A in the rotation direction (secondary scanning direction).

The intermediate transfer portion 20 is provided with an intermediate transfer belt 21, a driving roller 22, a driven roller 23, and primary transfer rollers 24A, 24B, 24C, and 24D, and primarily transfers the toner images (developer images) formed on the peripheral surfaces of the photoreceptor drums 2A to 2D onto the surface of the intermediate transfer belt 21 as an image bearing member. The secondary transfer portion 30 secondarily transfers the toner image on the surface of the intermediate transfer belt 21 onto a sheet of paper.

The fixing portion 40 heats and fuses the toner image transferred onto the sheet of paper and then outputs the sheet of paper to a sheet output tray. A more detailed configuration of the fixing portion 40 is presented in FIG. 2. The sheet feed portion 50 is provided with a sheet feed cassette 51 or a manual feed tray 52 that are provided with sheets of paper different in size and feeds a sheet of paper selected from the sheets of paper from a corresponding portion such as the sheet feed cassette to the sheet conveying path 60.

Figure 2:
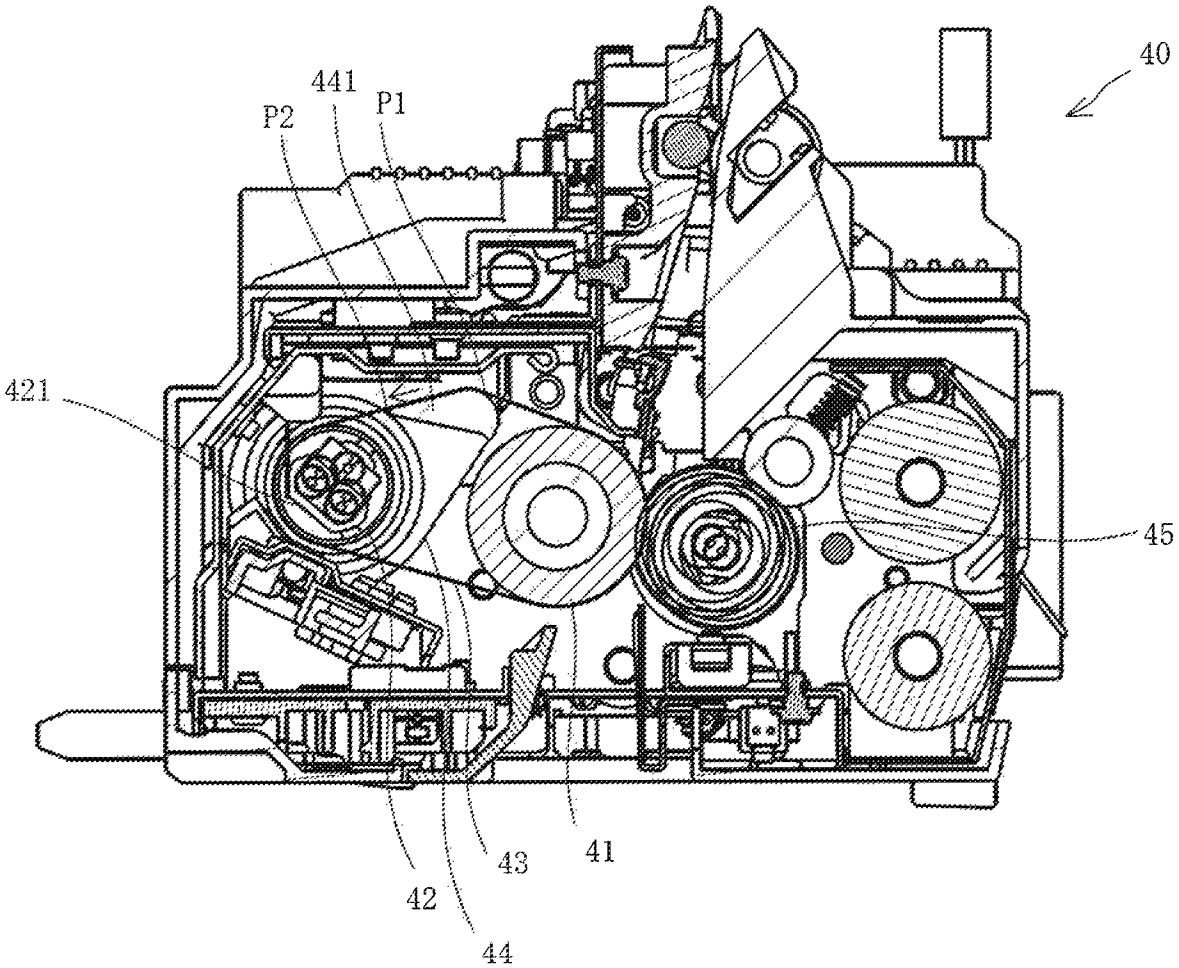
FIG. 2 is a sectional side view of a fixing portion according to a first preferred embodiment of the present invention.
Figure 3:
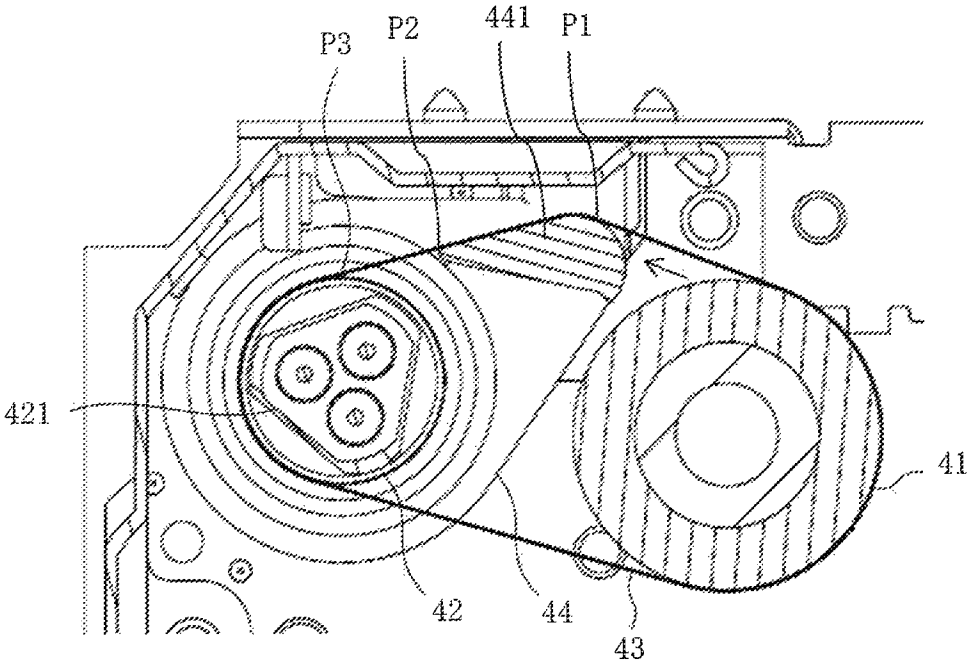
FIG. 3 is a partially enlarged view of FIG. 2.

The fixing portion 40, as illustrated in FIG. 2 and FIG. 3, has a fixing roller 41, a heating roller 42 that contains a heat source 421 such as a lamp heater, and an endless fixing belt 43 that is stretched between the fixing roller 41 and the heating roller 42. A pressurizing roller 45 is arranged to face the fixing roller 41 across the fixing belt 43. It is to be noted that the pressurizing roller 45 is brought into pressure contact with the fixing roller 41 through the fixing belt 43 by a biasing member such as a spring and forms a nip portion into which a sheet of paper is conveyed between the fixing belt 43 and the pressurizing roller 45. One of the fixing roller 41 and the heating roller 42 is rotatably driven by a non-illustrated fixing motor. Accordingly, the fixing belt 43 is rotatably driven, and, subsequently, the pressurizing roller 45 is driven with the rotation of the fixing belt 43.

A pad 44 is supported on both end sides by a support frame 40A of the fixing portion 40 (see FIG. 7A, FIG. 7B, FIG. 8A, and FIG. 8B) or a similar portion and is arranged in the right place on the side of the inner peripheral surface of the fixing belt 43. The pad 44 may preferably be arranged such that a contact surface portion 441 to be described later is brought into contact with the inner peripheral surface of the fixing belt 43, in the rotating direction (conveying direction) of the fixing belt 43 shown by an arrow in FIG. 3, between the fixing roller 41 and the heating roller 42, that is, on the upstream side of the heating roller 42.

Furthermore, as illustrated in FIG. 4A, FIG. 4B, FIG. 5A, FIG. 5B, FIG. 5C, FIG. 6A, FIG. 6B, and FIG. 6C, the pad 44 is provided with a contact surface portion 441 that has a dimension in the lengthwise direction corresponding to the width dimension of the fixing belt 43, a supporting portion 442 on the both ends of the contact surface portion 441, and a contact portion 443 positioned further outside of the supporting portion 442. The pad 44, from the point of operational stability and long lifetime, may preferably be made of resin that has heat resistance, for example, heat-resistant PPS (Poly Phenylene Sulfide) or heat-resistant PEEK (Poly Ether Ether Ketone). In addition, the pad 44 is biased by a biasing member 44*a* such as a compression spring, in a direction in which the contact surface portion 441 is brought into pressure contact with the fixing belt 43. The pad 44 is in pressure contact with the fixing belt 43, and, in a contact position, expands the rotation path of the fixing belt 43 outward so as to cause the fixing belt 43 to maintain a predetermined tension. The contact portion 443, as to be described in details later, is a plate-like body installed extending outward in the lengthwise direction of the pad 44, that is, a portion that the biasing member 44*a* contacts to cause a biasing force to act on the portion.

Figure 4B:
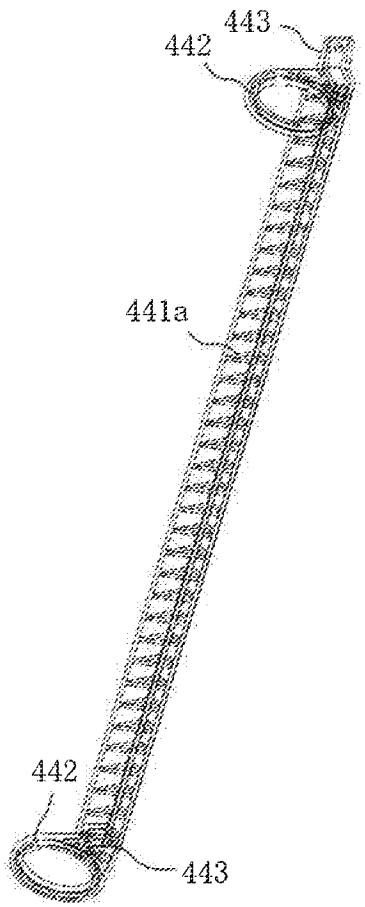
FIG. 4B is an external perspective view illustrating an example of a pad of which a contact surface portion is omitted.
Figure 5A:
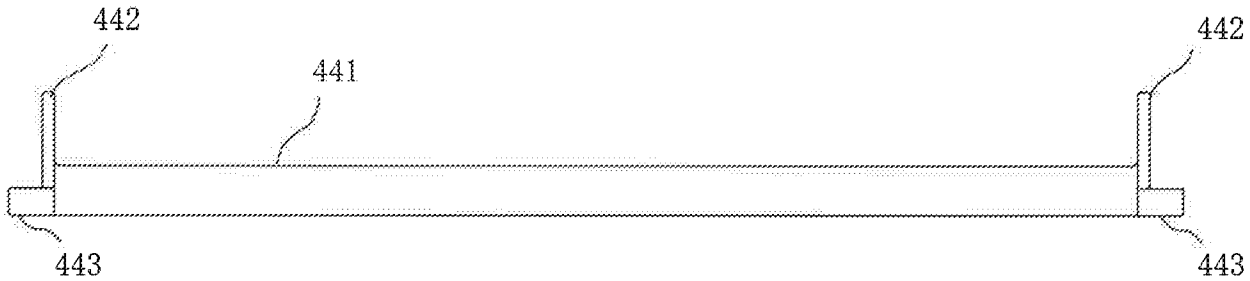
FIG. 5A is a plan view illustrating a structure of a pad.
Figure 5B:
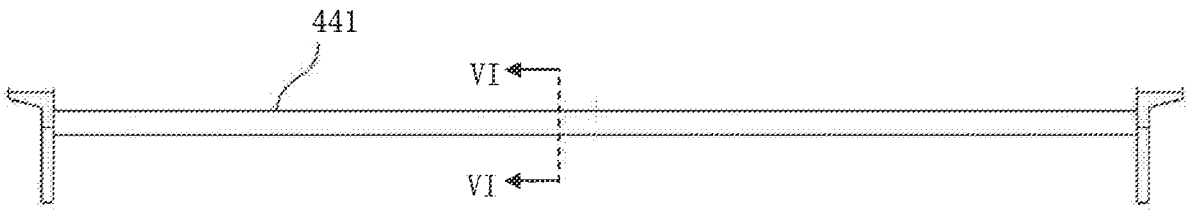
FIG. 5B is a front view illustrating a structure of the pad.
Figure 5C:
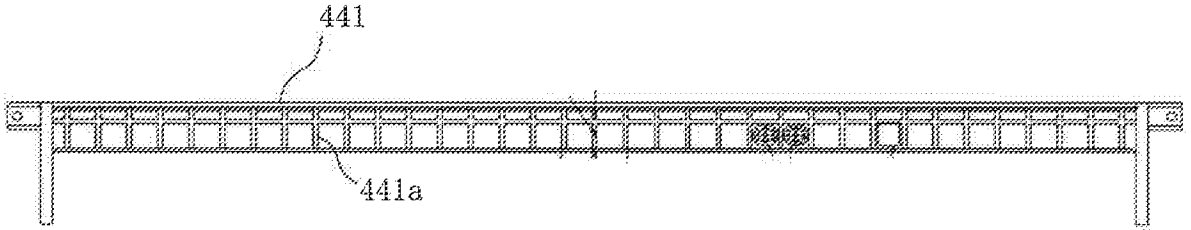
FIG. 5C is a bottom view illustrating a structure of the pad.
Figure 6A:
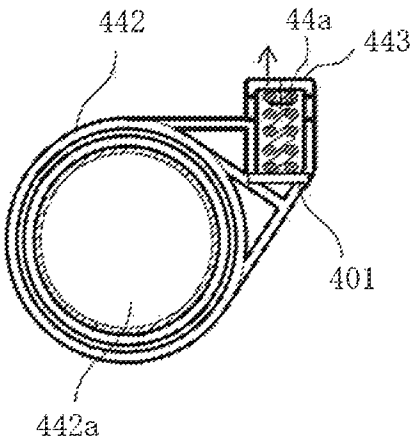
FIG. 6A is a left-hand side view illustrating a structure of the pad.
Figure 6B:
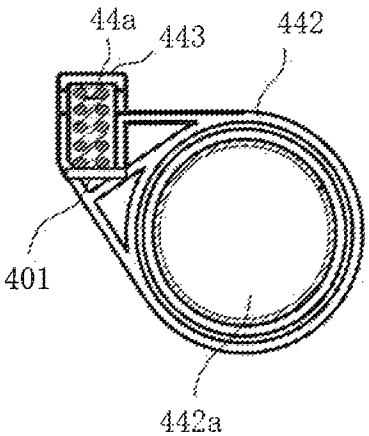
FIG. 6B is a right-hand side view illustrating a structure of the pad.
Figure 6C:
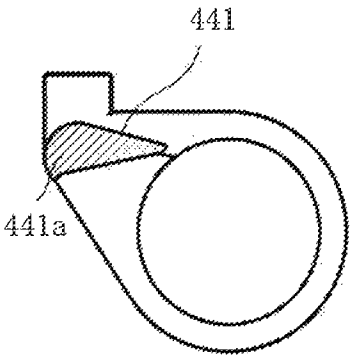
FIG. 6C is a view taken along an arrow line VI-VI, the view illustrating a structure of the pad.
Figure 7B:
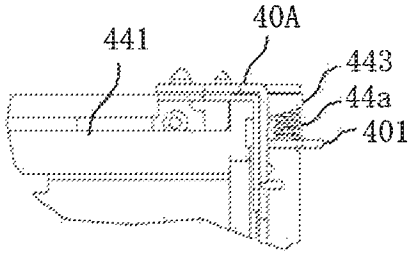
FIG. 7B is a partially enlarged view of a portion surrounded by a circle as shown in FIG. 7A.
Figure 7A:
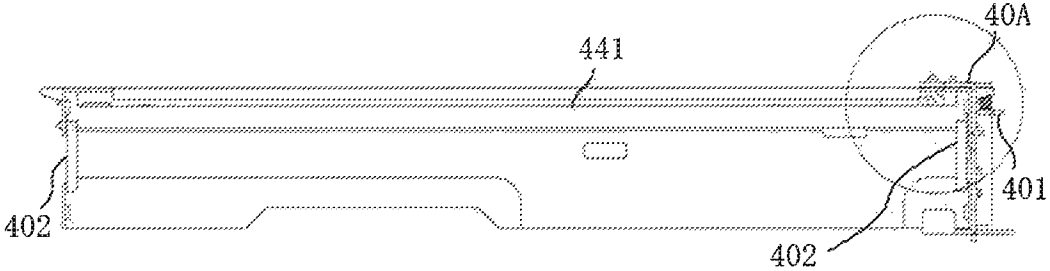
FIG. 7A is a front view illustrating a structure of a pad and a support frame.
Figure 8B:
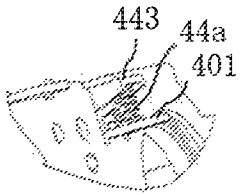
FIG. 8B is a partially enlarged view of a portion surrounded by a circle as shown in FIG. 8A.
Figure 8A:
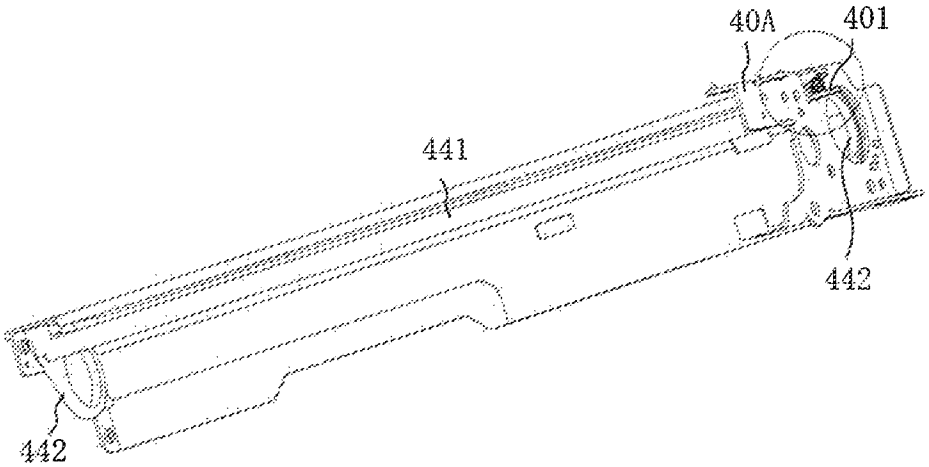
FIG. 8A is a perspective view from outside in an axial direction of a pad, the view illustrating a structure of the pad and the support frame.

The contact surface portion 441, as illustrated in FIG. 6C in particular, may preferably have a flat shape in the thickness direction and the shape of the upper surface may preferably have a projection-like or bulge-like curved surface in the conveying direction of the fixing belt 43. In addition, the contact surface portion 441 may preferably be formed to have a shape in which a length (a length dimension from a contact start point P1 in contact with the fixing belt 43 to a separation point P2 as shown in FIG. 3) corresponding to the conveying direction of the fixing belt 43 in a contact portion in contact with the fixing belt 43 is larger than a length (thickness) of the pad 44 corresponding to a normal direction of the fixing belt 43 in the contact portion. Accordingly, as compared with a case in which a roller is employed, it is possible to increase the contact area between the contact surface portion 441 and the fixing belt 43 while significantly reducing or preventing the contact surface portion 441 from increasing. A large contact area between the contact surface portion 441 and the fixing belt 43 increases the heat transfer efficiency and reduces the temperature unevenness in the width direction of the fixing belt 43. It is to be noted that, as illustrated in FIG. 4B and FIG. 5C, a structure in which a plurality of ribs 441*a* are arranged side by side is employed on the back side of the contact surface portion 441 and thus strength is maintained.

Moreover, the pad 44 may preferably include a first contact area (between P1 and P2 as shown in FIG. 3) in which the contact surface portion 441 contacts the fixing belt 43, a second contact area in which the heating roller 42 contacts the fixing belt 43, and a third contact area in which the fixing roller 41 contacts the fixing belt 43, and the pad 44 may preferably be arranged in a position in which a distance between the first contact area and the second contact area is smaller than a distance between the third contact area and the first contact area. Accordingly, the flap of the fixing belt 43 between the first contact area and the second contact area is significantly reduced or prevented, and the conveyance of the fixing belt 43 is stabilized.

In addition, the downstream side of the conveying direction of the contact surface portion 441 is directed to a portion (the contact start point P3 as shown in FIG. 3) in contact with the fixing belt 43 on the upstream side of the conveying direction of heating roller 42.

The supporting portion 442 includes an annular portion 442*a* formed in the direction perpendicular to the lengthwise direction of the contact surface portion 441. The annular portion 442*a* is fitted over the rotating shaft of the heating roller 42, which enables the supporting portion 442 to rotate around the heating roller 42. Accordingly, the pad 44 is supported so as to pivot about the rotating shaft of the heating roller 42.

In addition, as illustrated in FIG. 6A, FIG. 6B, FIG. 7A, FIG. 7B, FIG. 8A, and FIG. 8B, the contact portion 443 is formed to have a contact surface of a direction that has a component of the circumferential direction with respect to the rotating shaft of the heating roller 42, and, on the contact surface of the contact portion 443, a projecting piece 401 formed to be mainly cut and raised from the support frame 40A of the fixing portion 40 is provided to face the contact surface. Then, by the biasing member 44*a* interposed between the contact portion 443 and the projecting piece 401, the contact portion 443 is made into a state of being acted on by upward biasing force, and, in response to the upward biasing force, the pad 44 pivots about the rotating shaft of the heating roller 42 and is brought into pressure contact with the fixing belt 43. It is to be noted that the contact portion 443 and the projecting piece 401 may preferably include, for example, a projecting portion for preventing falling-off that is installed in a standing manner on each of the surfaces that face the contact portion 443 and the projecting piece 401 in order to prevent the biasing member 44*a* such as a spiral-shaped spring from falling off. In addition, as the biasing member 44*a*, any other various members other than the spiral-shaped spring are able to be employed as long as the members cause a biasing force to act on the contact portion 443. Moreover, the direction of the contact portion 443 and the projecting piece 401 may be any direction that has a component of the circumferential direction with respect to the rotating shaft of the heating roller 42, other than the vertical direction and may be a direction that matches the tangent of the circumferential direction, for example. Furthermore, as the contact portion 443, a mode in which a bottomed cylindrical body having an opening on a side that faces the projecting piece 401 has a bottom surface as a contact surface may be employed.

In addition, since the pad 44 is configured to pivot about the rotating shaft of the heating roller 42, the contact surface portion 441 is oriented so that one end portion of the contact area between the heating roller 42 and the fixing belt 43 is always positioned on the extension of the contact surface of the contact surface portion 441. Therefore, a distance between the contact area between the contact surface portion 441 and the fixing belt 43 and the contact area between the heating roller 42 and the fixing belt 43 becomes constant regardless of pivoting of the contact surface portion 441. Since a distance (between P2 and P3 as shown in FIG. 3) between the contact area between the contact surface portion 441 and the fixing belt 43 and the contact area between the heating roller 42 and the fixing belt 43 is configured to be small, the distance is able to be prevented from being larger even if the pad 44 pivots against the biasing member 44*a*, and therefore the flap of the fixing belt 43 is able to be significantly reduced or prevented, the flap occurring due to the vibration generated at a nip start point and at the end point while a sheet of paper passes, according to the thickness of the sheet of paper. Then, since the flap of the fixing belt 43 is significantly reduced or prevented, the change in the contact area between the heating roller 42 and the fixing belt 43 is significantly reduced or prevented, the amount of heat that the fixing belt 43 receives from the heating roller 42 is stabilized, and thus the temperature of the fixing belt 43 is also stabilized.

Second Preferred Embodiment

Figure 4A:
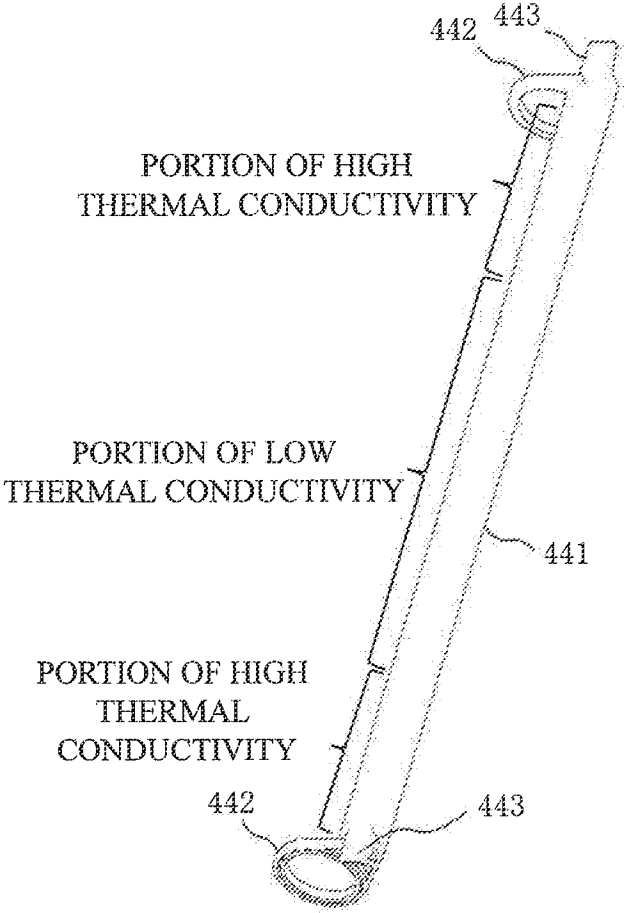
FIG. 4A is an external perspective view illustrating an example of a pad.

In addition, in the contact surface portion 441, as illustrated in FIG. 4A, a material of high thermal conductivity is employed for at least one end side or both end sides rather than the central portion, in the width direction (the lengthwise direction) of the fixing belt 43 that intersects perpendicularly with both the conveying direction and the normal direction of the fixing belt 43. In a case in which the end portion of the width direction of the fixing belt 43 becomes a non-sheet passing area, the temperature is liable to be higher in the end portion than in the central portion because heat is not taken away from a sheet of paper. Therefore, since the thermal conductivity of the contact surface portion 441 in the width direction of the fixing belt 43 is made higher in the end portion than in the central portion, the heat of the end portion in the width direction of the fixing belt 43 is able to be easily transferred to the central portion through the contact surface portion 441. Accordingly, the temperature of the fixing belt 43 is able to be easily made uniform in the width direction of the fixing belt 43. It is to be noted that the range of the high thermal conductivity on the one side or both sides may be set to outside of a sheet passing area of a sheet of paper of a general-purpose size. In addition, as other modes, (1) the thickness of the contact surface portion 441 is made thinner on both sides than in the center. (2) In the range of both sides of the contact surface portion 441, a metal material (AI: aluminum, for example) of which heat radiating effect is able to be expected is provided. Aluminum may be attached to the side of the ribs of the contact surface portion 441. In this manner, the thinness is able to improve the heat transmission property in (1), and the aluminum is able to release heat in (2).

Third Preferred Embodiment

While the contact surface portion 441 may be configured to be a shape in which a projection-like or bulge-like portion in contact with the inner peripheral surface of the fixing belt 43 is uniformly equal in the lengthwise direction, the shape may be a shape in which the height is gradually made higher in the normal direction from both ends toward the center, that is, a crown shape (a drum-like shape). According to such a configuration, since the meandering of the fixing belt 43 is able to be significantly reduced or prevented, the flap of the fixing belt 43 is significantly reduced or prevented, and, in addition, the variation of the contact area between the heating roller 42 and the fixing belt 43 is further significantly reduced or prevented, the amount of heat that the fixing belt 43 receives from the heating roller 42 is stabilized, and the temperature of the fixing belt 43 is also further stabilized.

It is conceivable that a new preferred embodiment may be configured by combining respective technical features of the above described preferred embodiments one another.

The foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. A fixing device comprising:

a fixing roller;

a heating roller having a heat source;

an endless belt stretched between the fixing roller and the heating roller;

a pressurizing roller arranged to face the fixing roller across the endless belt;

a pad having a contact surface in contact with an inner peripheral surface of the endless belt; and a biasing member applying a biasing force to the pad in a direction in which the contact surface is pressed against the inner peripheral surface of the endless belt, wherein the pad is configured so as to pivot about a rotating shaft of the heating roller in response to the biasing force.

2. The fixing device according to claim 1, wherein the pad is arranged so that the contact surface is in contact with the inner peripheral surface of the endless belt on an upstream side in a conveying direction of the endless belt with respect to the heating roller.

3. The fixing device according to claim 1, wherein the pad has a shape in which a length corresponding to a conveying direction of the endless belt in contact with the pad is larger than a length of the pad in a thickness direction corresponding to a normal direction of the endless belt in contact with the pad.

4. The fixing device according to claim 1, wherein:

the pad has a flat shape in a thickness direction; and the contact surface includes a bulge-like curved surface in a conveying direction of the endless belt.

5. The fixing device according to claim 1, wherein:

the fixing device includes a first contact area between the contact surface and the endless belt, a second contact area between the heating roller and the endless belt, and a third contact area between the fixing roller and the endless belt; and the pad is arranged so that a distance between the first contact area and the second contact area is smaller than a distance between the third contact area and the first contact area.

6. The fixing device according to claim 1, wherein the pad is configured so that, in a width direction of the endless belt, at least one end portion has a higher thermal conductivity than a central portion.

7. The fixing device according to claim 1, wherein the pad is made of resin having heat resistance.

8. An image forming apparatus comprising:

an image forming portion forming a toner image and transferring the toner image onto a sheet of paper; and the fixing device according to claim 1.

* * * * *